United States Patent [19]

Desbiolles et al.

[11] Patent Number: 4,817,981

[45] Date of Patent: Apr. 4, 1989

[54] APPARATUS FOR ADJUSTING THE LONGITUDINAL POSITION OF A SAFETY BINDING ON A SKI

[75] Inventors: Jack Desbiolles, Annecy; Pierre Feche, Cran-Gevrier, both of France

[73] Assignee: Salomon S.A., Annecy, France

[21] Appl. No.: 837,276

[22] Filed: Mar. 7, 1986

[30] Foreign Application Priority Data

Mar. 11, 1985 [FR] France ..... 85 03538

[51] Int. Cl.[4] ..... A63C 9/00

[52] U.S. Cl. ..... 280/633

[58] Field of Search ..... 280/616, 617, 618, 626, 280/629, 633, 634

[56] References Cited

U.S. PATENT DOCUMENTS

| | | | |
|---|---|---|---|
| 3,125,349 | 3/1964 | Schweizer | 280/626 |
| 3,635,485 | 1/1972 | Gertsch et al. | 280/617 |
| 3,785,666 | 1/1974 | Pierre et al. | 280/633 |
| 4,519,624 | 5/1985 | Bressand et al. | 280/633 |

FOREIGN PATENT DOCUMENTS

| | | |
|---|---|---|
| 0368394 | 1/1981 | Australia . |
| 2541471 | 6/1976 | Fed. Rep. of Germany . |
| 2521746 | 11/1976 | Fed. Rep. of Germany . |
| 2123966 | 9/1972 | France . |
| 2495479 | 6/1982 | France . |

*Primary Examiner*—John J. Love
*Assistant Examiner*—Richard Camby
*Attorney, Agent, or Firm*—Sandler & Greenblum

[57] ABSTRACT

An apparatus for adjusting the longitudinal position of a safety binding of a ski including a base plate attached to the binding and adapted to longitudinally slide in a guide on the ski. The base plate has a plurality of teeth adapted to engage a plurality of notches in the guide. Also provided is an apparatus for locking the teeth in the guide including a locking lever, a locking cam, and an elastic bearing. The locking lever is pivotally attached to the base plate by a first journal. The cam includes a second journal pivotally mounted on the base plate to rotate between locked and unlocked positions. Either the first or second journal is housed in the elastic bearing. Rotation of the cam from the unlocked to the locked position rotates the locking lever to displace the teeth into the notches and longitudinally displaces the journal housed in the elastic bearing, thereby compressing the bearing and biasing the teeth against displacement out of the notches. An element is provided for preventing substantial displacement of the journal housed by the elastic bearing in the transverse direction. This element may be the bearing itself or an abutment on the base plate for preventing transverse displacement of a cylindrical surface attached to the journal.

49 Claims, 5 Drawing Sheets

Fig. 7
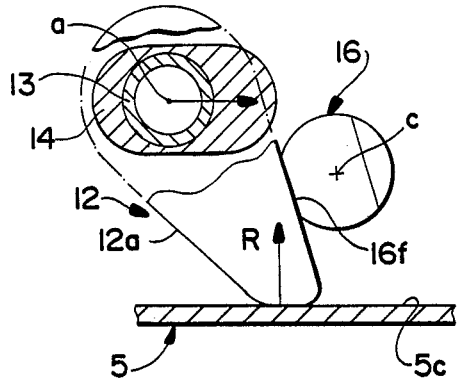
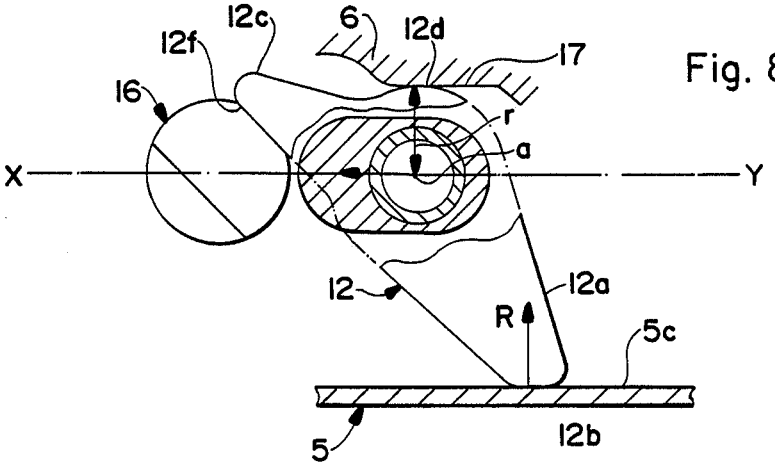
Fig. 8
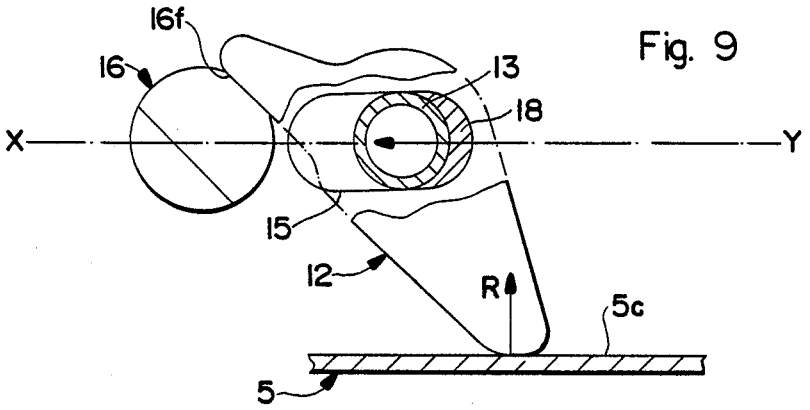
Fig. 9

APPARATUS FOR ADJUSTING THE LONGITUDINAL POSITION OF A SAFETY BINDING ON A SKI

BACKGROUND OF THE INVENTION

1. Field of the Invention

The present invention relates to an apparatus for adjustment of the longitudinal position of a safety binding on a ski.

2. Description of Pertinent Information

Ski boots are generally maintained on a ski between a front abutment, immobilizing the front end of the boot, and a rear abutment maintaining the heel of the boot on the ski. These front and rear abutments comprise the elements of a safety ski binding. To adapt the safety binding for use with boots of different sizes, bindings have been developed in which the longitudinal position of either the front or rear abutment (generally the rear abutment) is adjustable so that the distance between the front abutment and the rear abutment is adjusted to the longitudinal dimension of the boot to be maintained on the ski.

These apparatus for adjusting the longitudinal position of a safety binding generally comprise a guide fixed to the ski and a base plate attached to the binding. The base plate is adapted to slide in the longitudinal direction in the guide. In addition, the base plate can be locked in the guide at an appropriate longitudinal position corresponding to the length of the boot to be maintained on the ski.

One such apparatus is described in German Patent DE No. 25 21 746. In this apparatus the guide on the ski has, along one of its longitudinal edges, a plurality of spaced apart locking notches. In addition, the base plate is slidable in the longitudinal direction in the guide, and the base plate comprises a plurality of laterally extending teeth positioned along a portion of the longitudinal edge of the base plate facing the notches. Moreover, the width of the base plate is less than the internal width of the guide so that the base plate can slide freely in the guide to allow for the adjustment of the longitudinal position of the base plate. Once the base plate has been placed in the desired longitudinal position, the base plate is locked in the guide in this position by engagement of its laterally extending teeth with the locking notches of the guide under the action of a locking element. This locking element is longitudinally engaged between that side of the guide and the base plate opposite from the side of the guide and the base plate comprising the notches and the locking teeth. The locking element is longitudinally engaged between the base plate and the guide by applying a transverse force on the base plate directed towards the locking notches. This force maintains the engagement of the teeth of the base plate in the locking notches of the guide.

This apparatus has the disadvantage of requiring the use of a locking element which is independent of the binding and which must be forceably engaged longitudinally between the base plate and the guide, an operation which is not easy to carry out. Further, this apparatus does not guarantee that the base plate will be locked in the guide at a particular longitudinal position for a long period of time because the shocks and vibrations resulting from skiing cause a certain lateral play to appear, which leads an unlocking of the base plate from the chosen longitudinal position, thereby permitting the base plate to be longitudinally displaced in the guide and breaking the rigid link between the binding and the ski.

French Pat. No. 2,495,279 of Assignee describes another such adjustment apparatus. In this apparatus the locking element is incorporated into the binding and is biased by an elastic washer. Nevertheless this apparatus is not completely satisfactory because the washer has a considerable elasticity in the transverse direction so that one does not obtain firm maintenance of the base plate in the guide.

SUMMARY OF THE INVENTION

It is an object of the present invention to overcome the disadvantages of the prior art.

It is another object of the present invention to provide an adjustment apparatus which is easy to lock, which will maintain the binding in a particular longitudinal position for a long period of time and after repeated skiing, and which firmly maintains the apparatus on the ski in the transverse direction.

The invention which achieves these objectives relates to an apparatus for adjusting the longitudinal position of a safety binding on a ski. The apparatus comprises a first element and a second element. The two elements slidingly engage each other so that at least one of the elements is adapted to slide with respect to the other element in the longitudinal direction of the apparatus. One of the elements comprises a plurality of notches spaced apart in the longitudinal direction of the apparatus and the other of the elements comprises at least one tooth extending transversely to the longitudinal direction of the apparatus and adapted to engage the notches. Also provided are means for locking the at least one tooth in the plurality of notches. The locking means comprises a journal attached to one of the elements. In addition, means are provided for preventing substantial transverse displacement of the journal.

The apparatus further comprises an elastic bearing housing the journal. The elastic bearing comprises a portion that is substantially less elastically deformable in the transverse direction than in the longitudinal direction. The elastic bearing has two end portions of substantial transverse width, and intermediate portions connecting the two end portions. The intermediate portions have a substantially smaller transverse width than the two end portions. In addition, the elastic bearing has an opening therein, and the end portions comprise front and rear portions positioned frontwardly and rearwardly with respect to the opening. The intermediate portions are positioned on either transverse side of the opening.

In one embodiment the first element comprises a guide adapted to be attached to the ski, and the second element comprises a base plate slidingly engaging the guide. In another embodiment the invention relates to such an apparatus in combination with this binding. In this embodiment the second element comprises a base plate slidingly engaging the guide. The base plate is integral with said binding.

In still another embodiment the second element can be adapted to be attached to the binding, or the second element can comprise a support for the binding, having a base plate slidingly engaging the guide. In another embodiment the first element comprises a guide attached to the ski and the second element comprises a base plate slidingly engaging the guide. The guide has a substantially U-shaped cross-sectional configuration and comprises as least one tooth. The base plate includes a plurality of notches adapted to engage the at least one tooth. In still another embodiment the first element comprises a guide and a plurality of notches in the guide, and the second element comprises a base plate slidingly engaging the guide and comprising at least one tooth. Alternatively, instead of at least one tooth, the apparatus can comprise a plurality of teeth spaced apart in the longitudinal direction.

In another embodiment the first element comprises a guide attached to the ski. In this embodiment the second element comprises a base plate slidingly engaging the guide. The width of the base plate is smaller than the width of the guide. In this embodiment the locking means comprises means for exerting a transverse force on the apparatus to lock and maintain the at least one tooth in one of the notches, a first journal on the base plate, a locking lever pivotally mounted on the base plate by the first journal, and a locking cam comprising a second journal pivotally mounting the locking cam on the base plate. The transverse force exerting means comprises means for elastically biasing one of the elements into contact with the other of the elements in the transverse direction thereby locking and maintaining the at least one tooth in one of the plurality of notches. The locking lever comprises at least one branch comprising an end adapted to contact the first element. The journal recited as being attached to one of the elements and prevented from substantial transverse displacement by the transverse displacement prevention means comprises one of the first and second journals. In addition, the locking cam comprises an active lateral surface adapted to engage the locking lever. The locking cam is adapted to be rotated between locked and unlocked positions. The locking lever and the locking cam are positioned such that the at least one branch of the locking lever abuts the first element and the elastic means biases the at least one branch of the locking lever against the first element in response to rotation of the locking cam from the unlocked to the locked position.

The elastic means comprises an elastic bearing. One of the first and second journals is housed in the elastic bearing. The elastic bearing comprises means for retaining the journal housed in the elastic bearing against substantial displacement in the transverse direction and against substantial displacement except in the longitudinal direction. The locking cam and the locking lever are positioned such that the journal supported by the elastic bearing is displaced longitudinally causing axial deformation of the elastic bearing, thereby generating a transverse force of reaction of the first element on the at least one branch of the locking lever so as to maintain the at least one tooth firmly engaged in one of the locking notches in response to rotation of the locking cam from the unlocked to the locked position.

The guide and the base plate of the first and second elements each comprise first and second longitudinal sides. The at least one tooth is integral with and extends transversly from the first longitudinal side of one of the elements and the first longitudinal side of the other of the elements includes the plurality of locking notches. The second longitudinal side of the guide comprises an edge opposite from the first longitudinal side of the guide. The end of the at least one branch is adapted to contact the edge of the second longitudinal side of the guide. In this embodiment the locking lever and the locking cam are positioned such that the end of the at least one branch of the locking lever abuts the edge of the second longitudinal side of the guide in response to rotation of the locking cam from the unlocked to the locked position. In addition, the locking cam and the locking lever are positioned such that the journal supported by the elastic bearing is displaced longitudinally causing axial deformation of the elastic bearing, thereby generating a transverse force of reaction of the edge of the second longitudinal side of the guide on the at least one branch of the locking lever so as to maintain the at least one tooth firmly engaged in one of the notches in response to rotation of the locking cam from the unlocked to the locked position.

The first journal pivotally mounts the locking lever on the base plate around a first axis substantially perpendicular to the plane of the ski and the second journal is pivotally mounted on the base plate around a second axis substantially perpendicular to the plane of the ski. The first journal is housed in the elastic bearing, the base plate includes an opening, and the opening comprises a bearing for the locking cam so that the locking cam is pivotally mounted in the opening. Alternatively, the second journal is housed in the elastic bearing. In this embodiment the base plate includes a cylindrical opening therein. The first journal is mounted in this cylindrical opening. The diameter of the opening and the first journal are substantially the same so that the opening comprises a bearing for the first journal.

In one embodiment the active lateral surface of the locking cam comprises a first substantially flat surface adapted to contact the locking lever in response to positioning the locking cam in the locked position. In addition, the locking lever further comprises first and second branches. The first branch contacts and is elastically biased against the first longitudinal side of the guide in response to rotation of the cam into the locked position. The active lateral surface of the locking cam further comprises a second substantially flat surface positioned closer to the second axis than the first substantially flat surface. The second substantially flat surface comprises means for permitting the free rotational movement of the locking lever in response to rotation of the locking cam into a position in which the second substantially flat surface faces the second branch of the locking lever. The first and second substantially flat surfaces comprise opposite edges of the active lateral surface, and the second substantially flat surface faces the second branch in response to rotation of the cam into the unlocked position. The second substantially flat surface is spaced from the second branch in response to rotating the cam from the locked to the unlocked position.

The base plate has an opening therein for receiving elastic bearing. The opening is symmetrical with respect to a third substantially vertical axis, and the first, second, and third axes are aligned along a longitudinal axis of the binding. In addition, the first, second, and third axes are aligned along the longitudinal axis of symmetry of the binding.

The base plate comprises a lower surface having an opening therein. In this embodiment the apparatus further comprises a locking plate comprising an end. The end of the locking plate comprises the at least one tooth and the opening opens onto and the locking plate extends from the first longitudinal side of the base plate so that locking plate faces the plurality of notches. The lower surface of the base plate further comprises an opening extending in the longitudinal direction, and the locking plate further comprises a projection extending in the longitudinal direction and adapted to be received in the longitudinal opening in the lower surface of the base plate. In one embodiment the locking plate comprises a plurality of teeth, each adapted to engage each of the notches. Also, the second longitudinal side of the base plate is opposite from the first longitudinal side and from the at least one tooth. The second longitudinal side is inclined in the direction of the longitudinal axis of symmetry of the binding in response to rotation of the cam into the locked position. The width of the base plate at the at least one tooth is less than the internal width of the guide measured from the first to the second longitudinal sides of the guide.

The base plate can have an elongated opening therein. In this embodiment the elastic bearing comprises an elongated block of elastic material having an opening in the center thereof. The elongated block has substantially the same shape and dimensions as the elongated opening in the base plate. The elongated block is housed in the elongated opening. The elongated block comprises a central portion and two opposite end portions. The central portion is in the shape of a rectangle and the two opposite ends are semicircular in shape. More specifically, the rectangular-shaped central portion can have the shape of a square, or of a rectangle in which the length of adjacent sides are not equal. In addition, the opening in the block is in the central portion and the opening in the block is substantially circular.

The base plate can comprise a base. In this embodiment the displacement prevention means comprises means for preventing substantial displacement of one of the first and second journals in the transverse direction, and the substantial transverse displacement prevention means comprises an abutment positioned on the base of the base plate. The apparatus further comprises a cylindrical surface having an an arch-shaped cross-sectional configuration. The cylindrical surface is positioned on the journal housed in the elastic bearing. Each point on the cylindrical surface is substantially equidistant from one of the first and second axes. The cylindrical surface contacts the abutment, which comprises a substantially vertical planar surface substantially parallel to the longitudinal axis of symmetry of the apparatus and spaced from the longitudinal axis of symmetry by a distance substantially equal to the distance from the cylindrical surface to one of the first and second axes. In one embodiment the cylindrical surface is positioned on the locking lever and each point on the cylindrical surface is substantially equidistant from first axis. In another embodiment the cylindrical surface is positioned on the locking cam and each point on the cylindrical surface is substantially equidistant from the second axis.

The base plate can comprise an opening adapted to receive the elastic bearing and having substantially the same dimensions as the elastic bearing. The diameter of the journal housed in the elastic bearing is substantially equal to the width of the opening in the transverse direction. This opening comprises an end portion toward which the journal housed in this opening is displaced in response to pivoting of the locking cam into the locked position. The elastic bearing comprises an elastic element positioned in the end portion of the opening. In another embodiment the elastic bearing comprises only the elastic element positioned only in the end portion of the opening.

In one embodiment the locking lever comprises first and second branches. In this embodiment the second branch is positioned on the opposite side of the locking lever from the first branch, and the active lateral surface of the locking cam is adapted to contact the second branch. In addition, the active lateral surface of the locking cam contacts the second branch in response to rotation of the locking cam into the locked position. In an alternative embodiment the locking lever comprises only a single branch. The locking cam is adapted to contact this single branch. This single branch comprises a first and second end portions. The first end portion is adapted to contact the second longitudinal side of the guide, and the first journal is positioned at the second end portion.

The invention also relates to a subassembly of an apparatus for adjusting the longitudinal position of a safety binding on a ski. The apparatus comprises a first element comprising a guide and a second element comprising a base plate adapted to slide longitudinally in the guide. One of the elements includes a plurality of notches spaced apart in the longitudinal direction of the apparatus. The other of the elements comprises at least one tooth adapted to engage the notches. The subassembly comprises means for locking the at least one tooth in the plurality of notches. The locking means comprises a journal attached to one of the elements. Also provided are means for preventing substantial displacement of the first journal in a direction transverse to the apparatus.

The displacement prevention means comprises an elastic bearing for housing the journal. The elastic bearing has substantially less transverse elasticity than longitudinal elasticity, and the bearing prevents substantial transverse displacement of the journal. The elastic bearing has an opening therein for receiving the journal, and the elastic bearing comprises a central portion and two end portions extending in the longitudinal direction from opposite sides of the central portion. The central portion is substantially rectangular in shape and the two end portion are substantially semi-circular in shape. More specifically, the central portion is square in shape, and the opening is positioned in the central portion of the elastic bearing.

The guide of the first element of the apparatus and the base plate each comprise comprise first and second longitudinal sides. In addition, the at least one tooth extends transversly from the first longitudinal side of one of the elements. The notches are positioned in the first longitudinal side of the other of the elements. The locking means of the subassembly further comprises a first journal and a locking lever having at least one branch having an end. The first journal pivotally mounts the locking lever on the base plate such that the end of the locking lever is adapted to contact the second longitudinal side of the guide. The at least one tooth is maintained in one of the notches in response to pressure of the end of the at least one branch of the locking lever on the second longitudinal side of the guide.

The locking means further comprises a locking cam pivotally attached to the base plate and adapted to rotate between locked, intermediate and unlocked positions. In the intermediate position the cam rotates the locking lever to press the end of the at least one branch of the locking lever on the second longitudinal side of the guide. Rotation of the cam from the intermediate to the locked position pivots the locking lever around the end of the at least one branch, thereby longitudinally displacing the first journal against the elastic bearing and biasing the end of the at least one branch against the second longitudinal side of the guide and biasing the at least one tooth into engagement with one of the notches.

The locking means further comprises a locking lever pivotally mounted on the base plate and a locking cam comprising the journal. The journal is pivotally mounted on the base plate and the journal is adapted to rotate between locked and unlocked positions. The journal is displaced longitudinally against the elastic bearing in response to rotation of the journal from the unlocked to the locked position. As a result, the locking lever comprises means for biasing the base plate to pivot so that the at least one tooth engages one of the notches in response to rotation of the journal into the locked position.

In another embodiment the assembly further comprising an elastic bearing for housing the journal, and the locking means further comprises a locking lever pivotally mounted on the base plate around a first journal. Also provided is a locking cam comprising a second journal pivotally mounted on the base plate for rotation between locked and unlocked positions. The locking lever is adapted to rotate around a first axis defined by the first journal. The second journal is adapted to rotate around a second axis. The locking lever comprises means for rotating the base plate into a locked position in which the at least one tooth engages one of the notches. The cam comprises means for rotating the locking lever to rotate the base plate into the locked position. In addition, the journal housed by the elastic bearing comprises one of the first and second journals. The elastic bearing comprises means for biasing the lever against displacement out of the locked position in response to rotation of the locking cam into the locked position. The transverse displacement prevention means comprises an abutment positioned on the base of the base plate. The apparatus further comprises a cylindrical surface having an an arch-shaped cross-sectional configuration. The cylindrical surface is positioned on the journal housed in the elastic bearing. Each point on the cylindrical surface is substantially equidistant from one of the first and second axes. In addition, the cylindrical surface contacts the abutment. Further, the abutment comprises a substantially vertical planar surface substantially parallel to the longitudinal axis of symmetry of the apparatus and spaced from the longitudinal axis of symmetry by a distance substantially equal to the distance from the cylindrical surface to one of the first and second axes.

BRIEF DESCRIPTION OF THE DRAWINGS

The invention will be better understood from reading the detailed description which follows in conjunction to the attached drawings in which:

FIGS. 7, 8 and 9 illustrate partial cross-sectional views of different embodiments of the locking apparatus of the present invention in which the locking apparatus is in its locked position.

DETAILED DESCRIPTION OF PREFERRED EMBODIMENTS

The present invention remedies the disadvantages of the prior art noted above by providing an apparatus of particularly simple construction which avoids the use of a locking element independent of the binding and which assures a firm and permanent locking of the base plate in the guide.

To achieve this goal, the present invention provides an apparatus for adjusting the longitudinal position of a safety binding on a ski. The apparatus comprises two elements, one of which is mounted to slide in the longitudinal direction with respect to the other element. More specifically, the apparatus includes a longitudinally extending guide on the ski, and a base plate with a smaller width than that of the guide. The base plate is adapted to slide in the longitudinal direction in the guide. Also provided is at least one tooth integral with and extending laterally from a first longitudinal side of one of the elements of the binding. This at least one tooth is adapted to engage each of a plurality of locking notches, spaced apart from each other in the longitudinal direction and positioned in a first longitudinal side of the other binding element, which is adjacent to the longitudinal side of the element comprising the tooth.

Also provided are locking means for exerting on the base plate a transverse force to maintain the teeth engaged in one of the locking notches. The locking means comprises a locking lever having a first journal pivotally mounting the lever on the base plate around a first axis substantially perpendicular to the plane of the ski. The lever also comprises at least one branch whose end is adapted to contact the edge of that portion of the guide which is opposite the locking notches. The apparatus also comprises a locking cam having a second journal pivotally mounted in the base plate around a second axis substantially perpendicular to the ski. The cam comprises an active lateral surface which is adapted to engage the locking lever. The apparatus further comprises an elastic bearing in which is lodged the first or second journals, and transverse retention means of the journal lodged in the bearing so that this journal cannot be substantially displaced except in the longitudinal direction. In addition, the cam and the locking lever are positioned, one with respect to the other, in such a manner that rotation of the locking cam from an unlocked position to a locked position first causes the end of the at least one branch of the locking lever to abut against the adjacent edge of the guide, and then the cam causes the longitudinal displacement of the journal lodged in the elastic bearing. As a result, the elastic bearing is elastically axially deformed, thereby generating a transverse reaction force of the side of a guide on the end of the at least one branch of the lever which maintains the teeth firmly engaged in the locking notch or notches.

Figure 1:
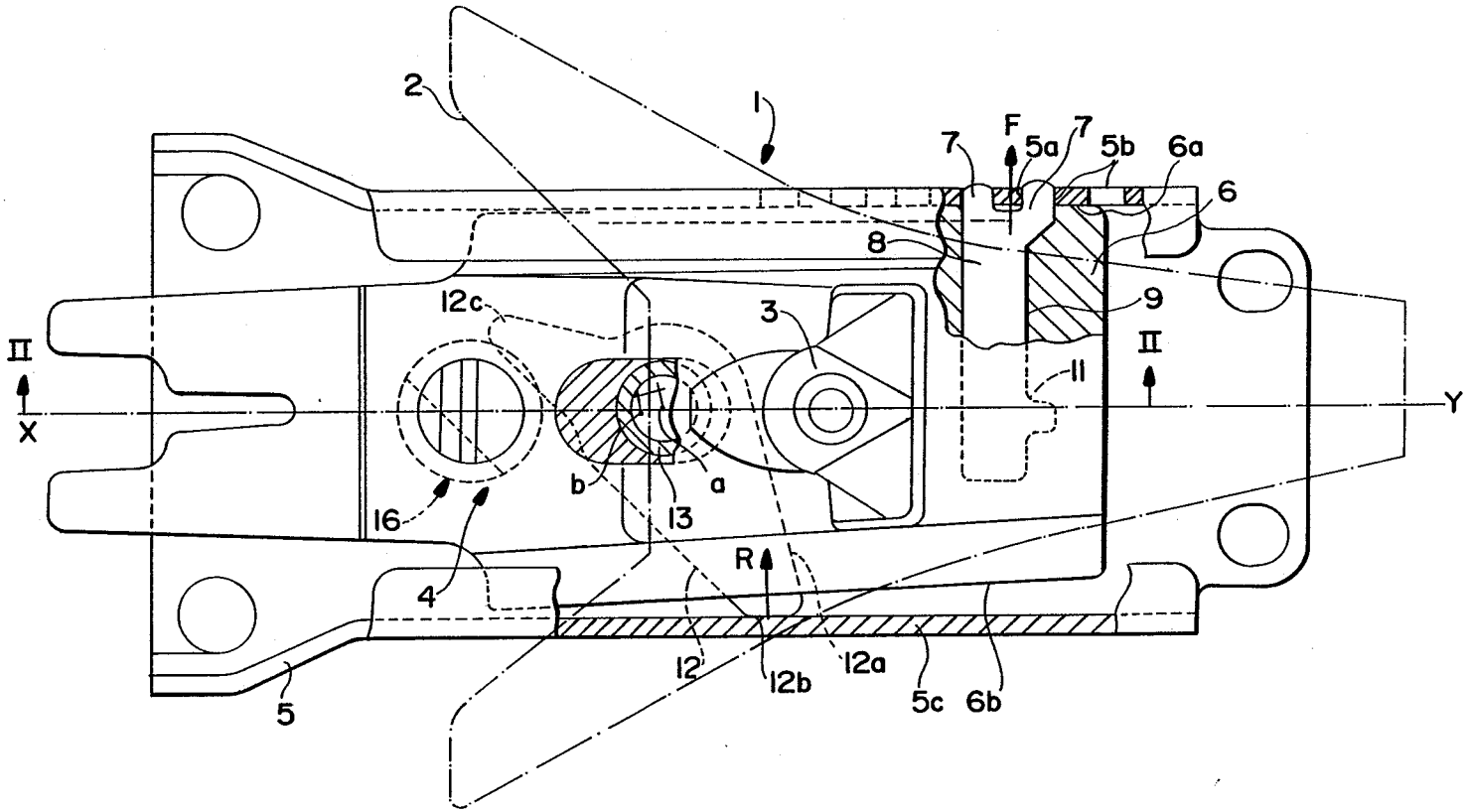
FIG. 1 illustrates a planar view, partially in horizontal cross section, of an adjustment apparatus of the longitudinal position of a safety binding of a ski of the present invention, in which the locking apparatus is in its locked position.
Figure 2:
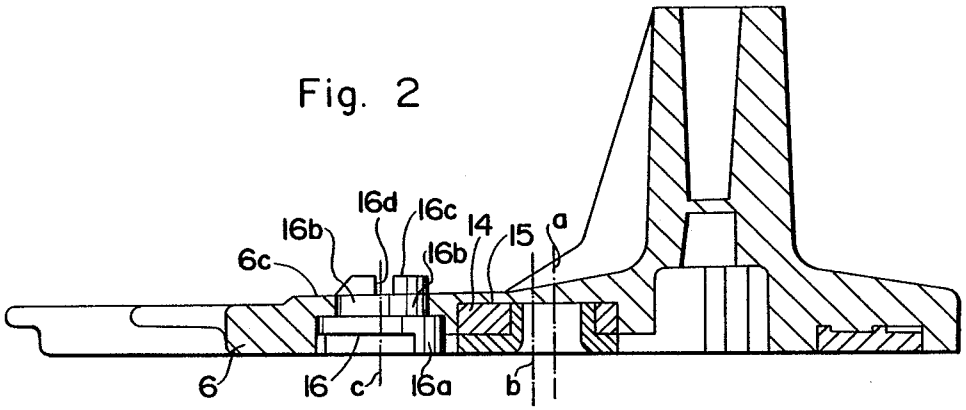
FIG. 2 illustrates an axial and vertical crosssectional view taken along line II—II in FIG. 1 of the base plate of the binding illustrated in FIG. 1.

As illustrated in FIG. 1 the present invention relates to an apparatus for adjusting the longitudinal position of a safety binding. The binding can comprise a front abutment 1 shown in FIG. 1. However, it should be understood that it is within the scope of the present invention to apply the present invention to a heel abutment. Front abutment 1 is of any appropriate type and can comprise, for example, a mobile assembly, illustrated in broken lines, comprising a jaw 2 having a portion that can pivot on a support 3. Support 3 is integral with a base plate 4. Base plate 4 is mounted so as to slide in the longitudinal direction of the apparatus and binding 1 in a guide 5 fixed to the ski. Also provided are means for locking base plate 4 in a position in guide 5 corresponding to the longitudinal dimension of the boot attached to the ski by binding 1. This means will be described in more detail below.

The cross-sectional configuration of guide 5 along at least a majority of its length is substantially in the shape of a C. As a result, the two lateral portions of guide 5 each comprise a groove having the general cross-sectional configuration of a U. Each groove opens toward the other, i.e. the generally U-shaped cross-sectional configuration of each groove opens in the direction of the longitudinal plane of symmetry of the apparatus and binding 1 passing through longitudinal axis of symmetry xy of binding 1 and the apparatus as seen in FIG. 1. One of the lateral grooves, for example the left groove, (when one views FIG. 1 from the rear of binding 1 and looks forward) has, at its bottom portion 5*a* (at the bottom of the U) a plurality of notches 5*b*. Notches 5*b* extend substantially perpendicular to the ski and are regularly spaced from each other in the longitudinal direction of the binding, the apparatus, and the ski. Notches 5*b* comprise locking notches. The opposite groove, i.e. the the right groove, has a continuous bottom portion 5*c* (at the bottom of the U) with no notches therein. In addition, base plate 4 itself comprises a base 6 whose width is slightly smaller than the width of guide 5. The width of guide 5 is the distance between bottoms portions 5*a* and 5*c* of the opposite lateral grooves of guide 5. Because the width of base 6 is smaller than the width of guide 5, base plate 4 can be displaced in gude 5 without substantial friction between base plate 4 and guide 5 when adjustment of the longitudinal position of the binding is desired.

The safety binding of the present invention further comprises locking means for immobilizing and locking base plate 4 on the guide 5 in any desired longitudinal position. This locking means comprises at least one locking tooth 7 adapted to engage one of locking notches 5*b*.

Figure 3:
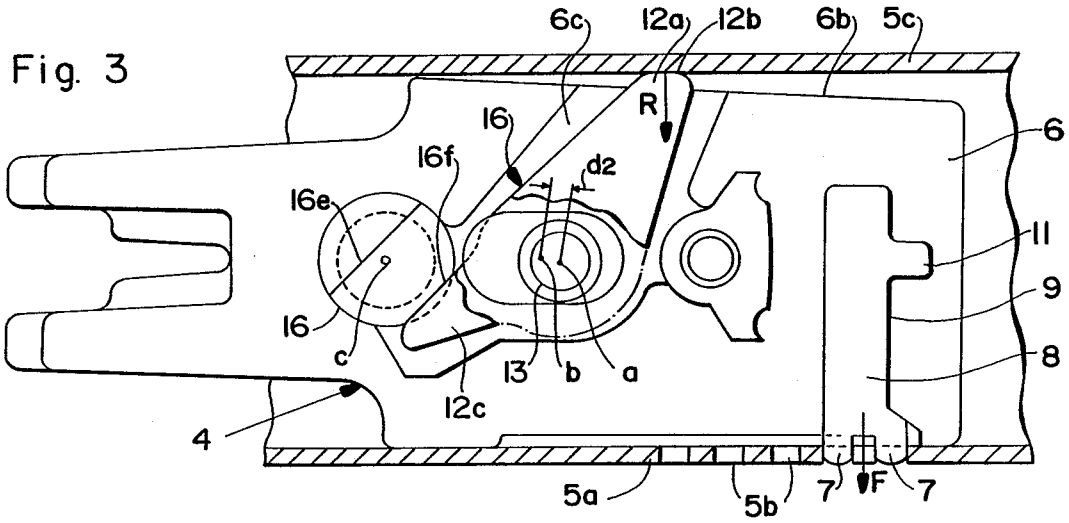
FIG. 3 illustrates a bottom view of the apparatus illustrated in FIG. 1, in which the locking apparatus is in its locked position.

Base plate 4 can comprise only one tooth 7 or several teeth, for example two teeth as illustrated in FIGS. 1 and 3. Two teeth 7 laterally project from left lateral side 6*a* of the base 6. Left side 6*a* of base 6 is adjacent to and located in the immediate proximity of perforated bottom portion 5*a* of the left groove of the guide 5. Teeth 7 are preferably formed at the end of a set-in locking plate 8. Locking plate 8 engages and is maintained in an opening or housing 9 located in the lower surface of base 6. Opening 9 opens onto left side 6*a* of the base which faces locking notches 5*b*.

One of the transverse sides of base plate 8 comprises a projecting tooth 11 which extends transversally, i.e. perpendicularly to longitudinal axis xy. Tooth 11 engages a housing or opening of the same shape which is provided in the lower surface of base 6. As a result, locking plate 8 and teeth 7 are integral with base 6 of base plate 4.

In an alternative embodiment teeth 7 could project towards the interior of the apparatus (e.g. toward axis xy) on bottom portion 5*a* of the left groove of guide 5, and the locking notches could comprise openings formed on side 6*a* of base 6.

Teeth 7 are locked and maintained in notches 5*b* by a locking apparatus. This apparatus comprises a locking lever 12, a journal 13 pivotally mounting lever 12 on base plate 6, a locking cam 16 for rotating lever 12, and an elastic bearing 14 for housing either journal 13 or cam 16. Base plate 6 has a sufficient width so that plate 6 can be pivoted within guide 5 between bottom portions 5*c* and 5*a*. In addition, teeth 7 project laterally a sufficient distance from plate 6 so that when right side 6*b* of plate 6 pivots toward axis xy a sufficient distance teeth 7 engage notches 5*b*, and when right side 6*b* pivots away from axis xy a sufficient distance teeth 7 disengage notches 5*b* to permit substantially free longitudinal displacement of base 6 in guide 5. The locking apparatus, which will be discussed in more detail below, biases base 6 and plate 4 to pivot so that teeth 7 engage notches 5*b*. In addition, the locking apparatus maintains a transverse force on plate 4 to maintain teeth 7 in notches 5*b*.

When the safety binding and the adjustment apparatus are in their locked position, as shown in FIG. 1, right side 6*b* of base 6 does not extend parallel to bottom 5*c* of the right groove of guide 5. Rather, right side 6*b* is tilted slightly forward in the direction of longitudinal axis xy. In addition, the width of base 6, when measured through teeth 7, is smaller than the internal width of the guide 5. Moreover, right side 6*b* has a laterally extending opening 6*c* therein. Opening 6*c* is formed in the lower surface of base 6 and is adapted to receive substantially flat locking lever 12. As a result, opening 6*c* and that portion of base 6 surrounding opening 6 forms a housing for locking lever 12. Lever 12 is integral with a journal 13 which extends upwardly. Lever 12 is pivotally mounted on base 6 around a substantially vertical axis a by journal 13. Locking lever 12 further comprises a first branch 12*a* and a second branch 12*c*. Branch 12*a* is inclined with respect to longitudinal axis xy, and is positioned to the right of axis xy (when one views FIG. 1 from the rear of binding 1 and looks forward). In addition, branch 12*a* projects laterally away from the right side 6*b* of base 6 to a small extent. Branch 12*a* comprises an end portion 12*a* which contacts bottom portion 5*c* of the right groove of guide 5 when the apparatus and the binding are in their locked position as illustrated in FIGS. 1 and 3. Second branch 12*c* is shorter than first branch 12*a* and is positioned on the opposite side of lever 12 from branch 12*a* so that branch 12*c* is located on the left side of longitudinal axis xy.

In the embodiment illustrated in FIGS. 1–5, journal 13 of locking lever 12 is housed in elastic bearing 14. Bearing 14 has an opening therein which extends through the elastic bearing along its entire height. The opening has substantially the same diameter as journal 13. Bearing 14 comprises comprising a block 14 having an elongated shape, i.e. having a length that is larger than its width. Bearing 14 is positioned in an opening 15 of substantially the same shape in the lower surface of base 6. Opening 15 extends symmetrically with respect to a substantially vertical axis b and opens up into the lower surface of base 6. Block 14 of the elastic bearing is composed of rubber or a rubber-type material. Further, block 14 can have, for example, the shape illustrated in FIGS. 1–5, i.e. a central substantially rectangular or substantially square portion and two substantially semi-circular portions which extend from opposite longitudinal ends of the central portion. Because elastic block 14 has a central opening through which axis A passes this opening demarcates two substantially thick portions having a substantial transverse width, and two thin portions having a substantially smaller transverse width than two substantially thick portions. The two substantially thick portions are front and rear portions of the bearing which are positioned in front of and behind the opening in the bearing. The two thin portions comprise two lateral intermediate portions which extend laterally from the opening and which connect the front and rear portions. As a result, bearing 14 has a high longitudinal elasticity and a large transverse rigidity. In addition, bearing 14 is substantially less elastically deformable in the transverse direction than in the longitudinal direction.

Second branch 12*c* of locking lever 12 is adapted to contact locking cam 16. Locking cam 16 is positioned rearwardly (or to the left when viewing FIG. 1) of locking lever 12. Locking cam 16 is pivotally mounted in an opening 10 in the base of base plate 4. As a result, opening 10 and that portion of base plate 4 immediately surrounding opening 10 comprise a bearing for cam 16.

Cam 16 comprises a journal adapted to rotate in base plate 4 around a substantially vertical axis c which passes through longitudinal axis xy. Locking cam 16 comprises a lower substantially cylindrical portion 16*a*, of a relatively large diameter, and an upper substantially cylindrical portion 16*b* of substantially smaller diameter than lower portion 16*a*. Lower portion 16*a* extends to upper portion 16*b*. In addition, cam 16 and upper portion 16*b* form a journal comprising a front upper surface 16*c* located slightly above the upper horizontal surface 6*c* of base 6. Upper surface 16*c* of locking cam 16 comprises a diametral slit 16*d* which is adapted to receive an appropriate tool, such as a screwdriver to permit one to turn locking cam 16 by engaging the tool in the diametral slit.

The lateral surface of lower cylindrical portion 16*a* comprises the active surface of locking cam 16 which is adapted to engage lever 12 as will be explained below. Lower cylindrical portion 16*a* does not extend to the entire diameter of cam 16 but is truncated so as to form two opposite substantially flat surfaces which are substantially parallel to each other. These two surface comprises a large surface 16*e*, positioned a small distance from the rotational axis c of locking cam 16, and a small surface 16*f* located at a greater distance from rotational axis c than surface 16*e*. Cam 16 is adapted to be rotated between an unlocked, an intermediate, and an locked position. In the locked position illustrated in FIGS. 1 and 3 small surface 16f contacts second branch 12*c* of locking lever 12, as illustrated in FIGS. 1 and 3, whereas in the unlocked position illustrated in FIG. 4 large surface 16*e* faces second branch 12*c* of locking lever 12, and is spaced a predetermined distance from second branch 12 so as to permit free angular movement of of locking lever 12.

Figure 4:
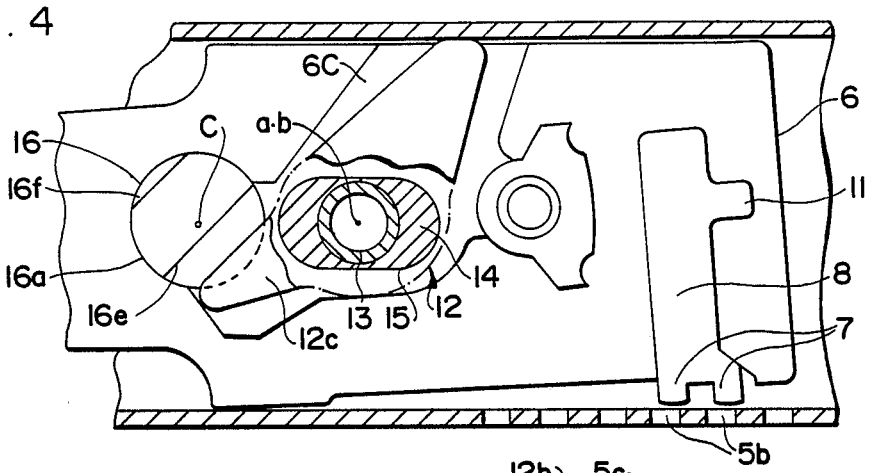
FIG. 4 illustrates a partially cutaway view from under the safety binding shown in FIG. 1, in which the locking apparatus is in its unlocked position.

The functioning of the adjustment apparatus of the present invention will now be discussed. In the unlocked position the binding and the apparatus can be substantially freely displaced in the longitudinal direction until these elements are positioned in the desired longitudinal position. This unlocked position is illustrated in FIG. 4. In this position, as was noted earlier, large surface 16*e* is spaced a distance from and faces second branch 12*c* of locking lever 12. Thus, second branch 12*c* can pivot freely up to a certain angle, as can locking lever 12. As a result, first branch 12*a* can then be totally hidden inside housing 6*c*. In this unlocked position elastic block 14 is not compressed or subjected to any constraint and axis a of journal 13 of the lever 12 coincides with axis b of opening 15 for housing block 14. Consequently, base 6 of the base plate 4 does not experience any transverse bias and base plate 4 can substantially freely "float" and be longitudinally displaced with respect to guide 5.

Figure 5:
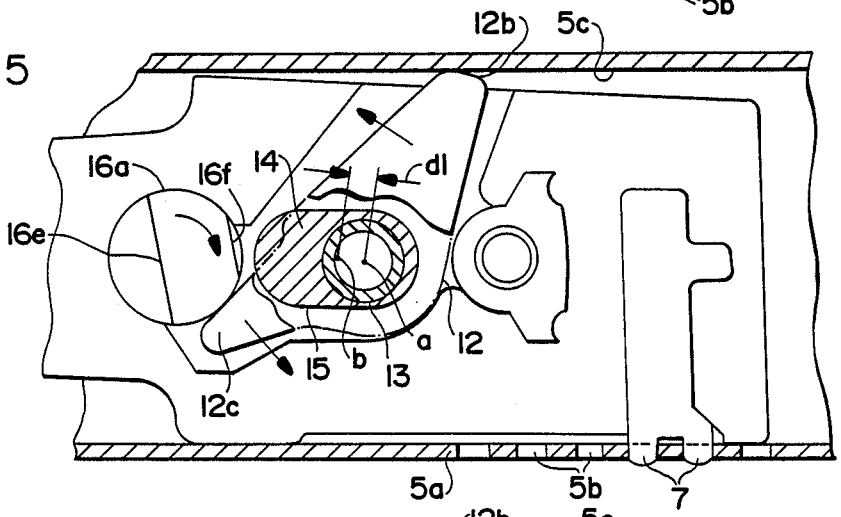
FIG. 5 illustrates a partially cutaway view from under the safety binding illustrated in FIG. 1, in which the locking apparatus is in an intermediate position between its locked and unlocked positions.

In order to lock the binding in the desired longitudinal position, teeth 7 are first located in front of the appropriate locking notches 5*b*, and one then rotates control cam 16 in one direction or in the opposite direction by means of a tool such as a screw driver. For example, one can rotate cam 16 in the clockwise direction, as illustrated in FIG. 5. At a certain point during this rotation, an end of large surface 16*e* contacts second branch 12*c* of locking lever 12 and then progressively pushes this branch in the counterclockwise direction, which also pivots locking lever 12 in the counterclockwise direction around axis a of its journal 13. At a certain point during this pivoting of lever 12, end 12*b* of first branch 12*a* contacts bottom portion 5*c* of the right groove of guide 5. From this moment bottom portion 5*c* comprises an immobilizing abutment for first branch 12*a*. Continued rotation of locking cam 16 pivots second branch 12*c* further away from rotational axis c of locking cam 16, and causes lever 12 to pivot around the point of contact between end 12*b* of lever 12 and bottom portion 5*c* of the right groove. As a result, journal 13 is displaced frontwardly and slightly toward the left so that axis a of journal 13 of lever 12 is displaced away from axis b of housing 15 due to the ability of elastic bearing 14 to be compressed. Consequently, the front portion of elastic block 14, (i.e. that portion of block 14 positioned between journal 13 and the front end of opening 15) is greatly compressed, whereas the rear portion of block 14 (i.e. that portion of block 14 between journal 13 and the rear end of opening 15) is extended. Similarly, the left portion of block 14, which is relatively thin, is very slightly compressed due to the slight transverse displacement to the left of journal 13 and axis a. The maximum distance $d_1$ between axes a and b occurs when second branch 12*c* is tangential to lower cylindrical portion 16*a*, as illustrated in FIG. 5.

Continued rotation of locking cam 16 rotates cam 16 through 180° compared to its starting position illustrated in FIG. 4. In this position small surface 16*f* contacts second branch 12*c* of locking lever 12. As a result, branch 12*c* is elastically pushed away upon contact with surface 16*f* due to a slight decompression of the compressed front portion of elastic block 14. This position is the locked position of the cam, the lever, and the apparatus, and is illustrated in FIGS. 1 and 3. In this position axis a of journal 13 is displaced slightly in the rearward direction so as to return to a small degree toward its unlocked position. The distance $d_2$ between axes a and b when the apparatus is in its locked position is smaller than the maximum distance $d_1$. Nevertheless, due to this residual offsetting $d_2$ between axes a and b, elastic block 14 continues to exert a return force on locking lever 12 directed substantially axially towards the rear or in other words, toward the left. This return force presses edge 12*b* of lever 12 against bottom portion 5*c* of groove 5, thereby generating a reaction force R exerted transversely on base 6 of base plate 4 which, in turn, generates a transverse force F biasing teeth 7 into notches 7 so as to assure the permanant maintenance of teeth 7 in locking notches 5*c*.

Because of the elongated shape of elastic block 14 (i.e. thin lateral portions connecting relatively thick front and rear portions), the transverse elasticity of bearing 14 is very weak. As a result, there is no lateral play of journal 13 in plate 4, and consequently there is no lateral play of plate 4 in guide 5. Thus, the apparatus has a high transverse rigidity when locked so that the binding will remain in the chosen logitudinal position. This desirable result would not occur had elastic bearing been formed in a circular shape.

Figure 6:
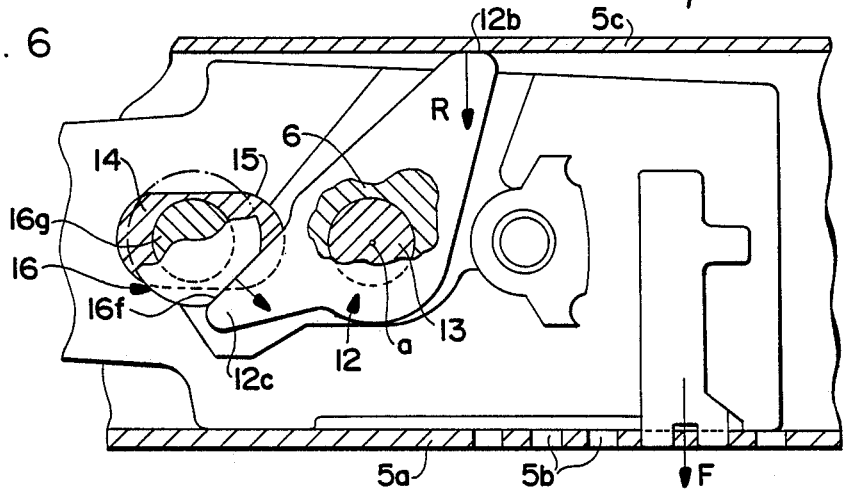
FIG. 6 illustrates a partially cutaway view from underneath the binding of another embodiment of the apparatus of the present invention in which the locking apparatus is in its locked position.

In the embodiment illustrated in FIG. 6 locking cam 16 is pivotally mounted in elastic block 14, rather than journal 13. In this embodiment housing 15 for block 14 is positioned at the location of cam 16. In addition, cam 16 comprises a cylindrical portion 16*g* comprising a journal of cam 16. Portion 16*g* engages a central opening of substantially the same diameter in elastic block 14. In this embodiment journal 13 of lever 12 is pivotally mounted in a cylindrical opening which forms a bearing in base 6 for journal 13 and which has substantially the same diameter as that of journal 13. In addition, the pivoting axis a of locking lever 12 is fixed. However, during the rotation of locking cam 16, its rotational axis c is offset with respect to axis b of housing 15, due to the ability of elastic block 14 to be compressed. In the locked position illustrated in FIG. 6, it is the front portion of elastic block 14 which is compressed and which then exerts on second branch 12*c* of locking lever 12 a force pivoting lever 12 in the counterclockwise direction as indicated in FIG. 6. This force generates, as in the previously described embodiments, a reaction force R and a transverse force F assuring the maintenance of the binding at the desired longitudinal position.

It is within the scope of the present invention for elastic block 14, whose substantial axial deformation produces transverse maintenance force F, to have a different shape than that discussed above. For example, elastic block 14 can have a rectangular or elliptical shape extending along axis xy or any other similar shape, as long as its central opening, in which either the journal of locking cam 16 or locking lever 12 is housed, is separated from the longitudinal walls of housing 15 by lateral portions composed of an elastic material of slight thickness.

Moreover, in the embodiments of the invention described above axis a of locking lever 12, axis b of housing 15, and axis c of locking cam 16 all cross the longitudinal axis xy. However, it is also within the scope of the present invention for a vertical plane passing through these three axes to be inclined with respect to longitudinal axis xy.

Figure 5A:
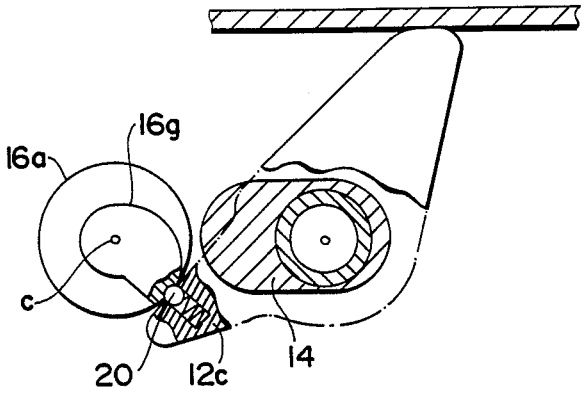
FIG. 5A illustrates a partially cutaway view from under the safety binding illustrated in FIG. 1 of an alternative embodiment of the present invention in which the distance between the axis around which the cam pivots and the contact point between the cam and the lever increases progressively as the cam rotates into its locked position.
Figure 6A:
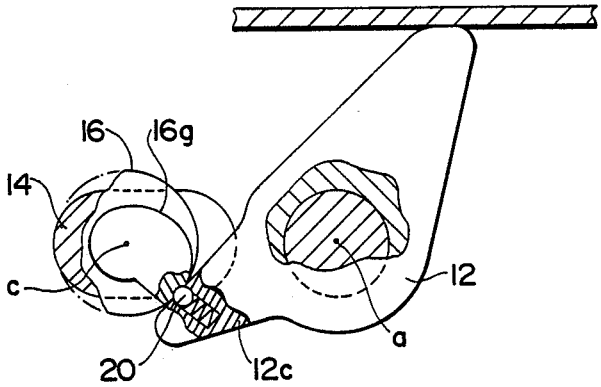
FIG. 6A illustrates a partially cutaway view from under the safety binding of an alternative embodiment of the cam and the lever, in which the cam is positioned in an opening in the elastic bearing, and in which the cam is so shaped that the distance between the axis around which the cam pivots and the contact point between the cam and the lever progressively increases as the cam rotates into its locked position.

It is also within the scope of the present invention for locking cam 16 to have a different shape than that described earlier. Although cam 16 uses a small surface 16f to securely maintenance cam 16 in the locked position, this maintenance of cam 16 in the locked position could be obtained by different means. For example, as is shown in the alternative embodiments illustrated in FIGS. 5A and 6A, cam 16 could have a lateral active surface 16g having a point of contact with second branch 12*c* of locking lever 12 which is spaced a certain distance from axis c. The active surface 16*g* is so shaped so that the distance from the point of contact to axis C increases progressively to a maximum radius corresponding as illustrated in to the locked position FIGS. 5A et 6A. To assure the the maintenance of cam 16 in this position, it would be necessary on branch to provide 12*c* an element 20 such as a ball bearing or a projection, elastically by a spring located in an opening in the branch biased and engaged in a groove in the cam or in another locked elastic system.

In the embodiment of the invention partially illustrated in FIG. 7 locking lever 12 comprises only one branch, branch 12*a*. In this embodiment journal 13 of lever 12 is located at the end of branch 12 which is opposite from end 12*b* of the branch that contacts bottom potion 5*c* of the left groove of guide 5. Locking cam 16, which is pivotally mounted around axis c, is positioned in front of locking lever 12, that is to say to the right of lever 12, as shown in FIG. 7. Surface 16*f* of cam 16 is adapted to push locking lever 12 towards the left, which compresses the rear portion of elastic block 14. As a result, block 14 exerts on journal 13 of lever 12 a frontward force, thereby and generating, as noted earlier, a reaction force R.

In the preceding embodiments elastic block 14 comprises one single portion which is pierced with a central opening defining two thin lateral portion linking thick front and rear portions of the block. As a result, axis a of journal 13 of locking lever 12 can undergo, as described earlier, a slight transverse displacement when locking cam 16 pushes lever 12 frontwardly or rearwardly by compressing the front or rear portion of the elastic block 14. To avoid this transverse displacement one can provide means for laterally retaining the journal housed by the elastic bearing.

The embodiment illustrated in FIG. 8 shows such a means. This lateral retention means comprises an abutment 17 provided in the base of base plate 4. In addition, a cylindrical surface 12*d* is provided which is adapted to contact abutment 17. Surface 12*d* has a cross-sectional configuration in the shape of an arc. Surface 12 can either be provided on lever 12 or on cam 16. When bearing 14 houses journal 13 of lever 12, then surface 12*d* is on lever 12, and the axis defining cylindrical surface 12*d* is axis a of journal 13. When bearing 14 houses a journal of cam 16, then surface 12*d* is provided on cam 16, and the axis defining surface 12*d* is axis c of cam 16. In other words, when bearing 14 houses journal 13, all of the points on surface 12*d* are equidistant from axis a. Abutment 17 comprises a substantially vertical substantially planer surface which is substantially parallel to longitudinal axis xy and which is positioned substantially at a distance from the axis of surface 12*d* equal to radius r of the cylindrical circular surface 12*d*. In this manner, pivoting axis a of locking lever 12 again crosses longitudinal axis xy, when block 14 is elastically deformed, and pivot 13 does not undergo any transverse displacement.

In the embodiment illustrated in FIG. 9 the journal housed in the elastic bearing (either journal 13 of locking lever 12 or journal 16g of locking cam 16) has a diameter substantially equal to the width of housing 15 in the transverse direction. In this embodiment as in the other embodiments, housing 15 has a longitudinally elongated shape. Elastic block 18 comprises a portion only housed in the extreme front part of housing 15, i.e. that portion of housing 15 toward which pivot 13 is pushed by locking cam 16 when cam 16 is rotated from the unlocked to the locked position. The cross-sectional shape of elastic block 18 is substantially in the form of a half moon, as illustrated in FIG. 9. Elastic block 18 is compressed when journal 13 is displaced in the frontward direction due to the rotation of locking cam 16 into the locked position, thereby generating, as in the preceding embodiments, a reaction force R. Journal 13 is tightly guided between the two longitudinal walls of housing 15 and consequently locking lever 12 has no transverse play.

Although the invention has been described with respect to particular means, methods, and embodiments, it should be understood that the invention is not limited thereto, but extends to all equivalents within the scope of the claims.

What is claimed is:

1. An apparatus for adjusting the longitudinal position of a safety binding on a ski, wherein said apparatus comprises:

(a) a guide element;

(b) a base plate element adapted to receive a binding, wherein said two elements slidingly engage each other so that at least one of said elements slides with respect to the other element in the longitudinal direction of said apparatus, wherein one of said elements comprises a plurality of notches spaced apart in the longitudinal direction of said apparatus, wherein the other of said elements comprises at least one tooth extending transversely to the longitudinal direction of said apparatus and engages said notches;

(c) means for locking said at least one tooth in said plurality of notches, wherein said locking means comprises a journal attached to one of said elements; and (d) means for preventing substantial transverse displacement of said journal by exerting an elastic transverse force on said base plate to substantially eliminate transverse play between said base plate element and said guide element and thus hold said at least one tooth in said plurality of notches.

2. The apparatus defined by claim 1 wherein said prevention means further comprises an elastic bearing housing said journal, wherein said elastic bearing comprises a portion that is substantially less elastically deformable in the transverse direction than in the longitudinal direction.

3. The apparatus defined by claim 2 wherein said elastic bearing has two end portions of substantial transverse width, and intermediate portions connecting said two end portions, wherein said intermediate portions have a substantially smaller transverse width than said two end portions.

4. The apparatus defined by claim 3 wherein said elastic bearing has an opening therein, wherein said end portions comprise front and rear portions positioned frontwardly and rearwardly with respect to said opening, wherein said intermediate portions are positioned on either transverse side of said opening.

5. The apparatus defined by claim 1 wherein said guide element is adapted to be attached to said ski, and wherein said base plate slidingly engages said guide.

6. The apparatus defined by claim 5 in combination with said binding wherein said base plate is integral with said binding.

7. The apparatus defined by claim 1 wherein said element is adapted to be attached to said binding.

8. The apparatus defined by claim 1 wherein said guide element is attached to said ski, wherein said base plate slidingly engages said guide element, wherein said guide element has a substantially U-shaped cross-sectional configuration and comprises said at least one tooth, wherein said base plate includes said plurality of notches adapted to engage said at least one tooth.

9. The apparatus defined by claim 1 wherein said guide element includes said plurality of notches, and wherein said base plate comprises said at least one tooth.

10. The apparatus defined by claim 1 wherein said apparatus comprises a plurality of teeth spaced apart in the longitudinal direction

11. The apparatus defined by claim 1 wherein said guide element is adapted to be attached to said ski, wherein said base plate slidingly engages said guide element, wherein the width of said base plate is smaller than the width of said guide, wherein said locking means comprises:

means for exerting a transverse force to lock and maintain said at least one tooth in one of said notches, wherein said transverse force exerting means comprises means for elastically biasing one of said elements into contact with the other of said elements in the transverse direction thereby locking and maintaining said at least one tooth in one of said plurality of notches;

a first journal on said base plate;

a locking lever pivotally mounted on said base plate by said first journal, wherein said locking lever comprises at least one branch comprising an end adapted to contact one of said elements; and a locking cam comprising a second journal pivotally mounting said locking cam on said base plate, wherein said journal recited in paragraph (c) comprises one of said first and second journals, wherein said locking cam comprises an active lateral surface adapted to engage said locking lever, wherein said locking cam is adapted to be rotated between locked and unlocked positions, wherein said locking lever and said locking cam are positioned such that said at least one branch of said locking lever abuts said guide element and said elastic means biases said at least one branch of said locking lever against said guide element in response to rotation of said locking cam from said unlocked to said locked position.

12. The apparatus defined by claim 11 wherein said elastic means comprises an elastic bearing, wherein one of said first and second journals is housed in said elastic bearing, wherein said elastic bearing comprises means for retaining said journal housed in said elastic bearing against substantial displacement in the transverse direction and against substantial displacement except in the longitudinal direction, wherein said locking cam and said locking lever are positioned such that said journal supported by said elastic bearing is displaced longitudinally causing axial deformation of said elastic bearing, thereby generating a transverse force of reaction of said first element on said at least one branch of said locking lever so as to maintain said at least one tooth firmly engaged in one of said locking notches in response to rotation of said locking cam from said unlocked to said locked position.

13. The apparatus defined by claim 12 wherein said guide element and said base plate element each comprise first and second longitudinal sides, wherein said at least one tooth is integral with and extends transversely from said first longitudinal side of one of said elements, wherein the the first longitudinal side of the other of said elements includes said plurality of locking notches, wherein said second longitudinal side of said guide comprises an edge opposite from said first longitudinal side of said guide, wherein said end of said at least one branch is adapted to contact said edge of said second longitudinal side of said guide, wherein said locking lever and said locking cam are positioned such that said end of said at least one branch of said locking lever abuts said edge of said second longitudinal side of said guide in response to rotation of said locking cam from said unlocked to said locked position, wherein said locking cam and said locking lever are positioned such that said journal supported by said elastic bearing is displaced longitudinally causing axial deformation of said elastic bearing, thereby generating a transverse force of reaction of said edge of said second longitudinal side of said guide on said at least one branch of said locking lever so as to maintain said at least one tooth firmly engaged in one of said notches in response to rotation of said locking cam from said unlocked to said locked position.

14. The apparatus defined by claim 13 wherein said first journal pivotally mounts said locking lever on said base plate element around a first axis substantially perpendicular to the plane of said ski, wherein said second journal is pivotally mounted on said base plate element around a second axis substantially perpendicular to the plane of said ski.

15. The apparatus defined by claim 14 wherein said first journal is housed in said elastic bearing, wherein said base plate element includes an opening, wherein said opening comprises a bearing for said locking cam, wherein said locking cam is pivotally mounted in said opening.

16. The apparatus defined by claim 14 wherein said second journal is housed in said elastic bearing, wherein said base plate element includes a cylindrical opening therein, wherein said first journal is mounted in said cylindrical opening, wherein the diameter of said opening and said first journal are substantially the same, wherein said opening comprises a bearing for said first journal.

17. The apparatus defined by claim 14 wherein said active lateral surface of said locking cam comprises a first substantially flat surface adapted to contact said locking lever in response to positioning said locking cam in said locked position.

18. The apparatus defined by claim 17 wherein said locking lever further comprises first and second branches, wherein said first branch contacts and is elastically biased against said first longitudinal side of said guide element in response to rotation of said cam into said locked position, wherein said active lateral surface of said locking cam further comprises a second substantially flat surface positioned closer to said second axis than said first substantially flat surface, wherein said second substantially flat surface comprises means for permitting the free rotational movement of said locking lever in response to rotation of said locking cam into a position in which said second substantially flat surface faces said second branch of said locking lever.

19. The apparatus defined by claim 18 wherein said first and second substantially flat surfaces comprise opposite surfaces of said active lateral surface, wherein said second substantially flat surface faces said second branch in response to rotation of said cam into said unlocked position.

20. The apparatus defined by claim 19 wherein said second substantially flat surface is spaced from said second branch in response to rotating said cam from said locked to said unlocked position.

21. The apparatus defined by claim 14 wherein said base plate has an opening therein for receiving said elastic bearing, wherein said opening is symmetrical with respect to a third substantially vertical axis, wherein said first, second, and third axes are aligned along a longitudinal axis of said binding.

22. The apparatus defined by claim 21 wherein said first, second, and third axes are aligned along the longitudinal axis of symmetry of said binding.

23. The apparatus defined by claim 14 wherein said base plate comprises a lower surface having an opening therein, wherein said apparatus further comprises a locking plate comprising an end, wherein said end of said locking plate comprises said at least one tooth, wherein said opening opens onto and said locking plate extends from said first longitudinal side of said base plate so that locking plate faces said plurality of notches.

24. The apparatus defined by claim 25 wherein said lower surface of said base plate element further comprises an opening extending in the longitudinal direction, wherein said locking plate further comprises a projection extending in the longitudinal direction and adapted to be received in said longitudinal opening in said lower surface of said base plate.

25. The apparatus defined by claim 23 wherein said locking plate comprises a plurality of teeth, each adapted to engage each of said notches.

26. The apparatus defined by claim 23 wherein said second longitudinal side of said base plate is opposite from said first longitudinal side and from said at least one tooth, wherein said second longitudinal side is inclined in the direction of the longitudinal axis of symmetry of said binding in response to rotation of said cam into said locked position, wherein the width of said base plate at said at least one tooth is less than the internal width of said guide measured from said first to said second longitudinal sides of said guide.

27. The apparatus defined by claim 14 wherein said base plate element has an elongated opening therein, wherein said elastic bearing comprises an elongated block of elastic material having an opening in the center thereof, wherein said elongated block has substantially the same shape and dimensions as said elongated opening in said base plate element, wherein said elongated block is housed in said elongated opening.

28. The apparatus defined by claim 27 wherein said elongated block comprises a central portion and two opposite end portions, wherein said central portion is in the shape of a rectangle, wherein said two opposite ends are semicircular in shape.

29. The apparatus defined by claim 28 wherein said rectangular-shaped central portion has the shape of a square.

30. The apparatus defined by claim 28 wherein said opening in said block is in said central portion, wherein said opening in said block is substantially circular.

31. The apparatus defined by claim 14 wherein said base plate element comprises a base, wherein said displacement prevention means comprises means for preventing substantial displacement of one of said first and second journals in the transverse direction, wherein said substantial transverse displacement prevention means comprises an abutment positioned on said base of said base plate, wherein said apparatus further comprises a cylindrical surface, wherein said cylindrical surface has an arch-shaped cross-sectional configuration, wherein said cylindrical surface is positioned on said journal housed in said elastic bearing, wherein each point on said cylindrical surface is substantially equidistant from one of said first and second axes, wherein said cylindrical surface contacts said abutment, wherein said abutment comprises a substantially vertical planar surface substantially parallel to the longitudinal axis of symmetry of said apparatus and spaced from said longitudinal axis of symmetry by a distance substantially equal to the distance from said cylindrical surface to one of said first and second axes.

32. The apparatus defined by claim 31 wherein said cylindrical surface is positioned on said locking lever and each point on said cylindrical surface is substantially equidistant from first axis.

33. The apparatus defined by claim 31 wherein said cylindrical surface is positioned on said locking cam and each point on said cylindrical surface is substantially equidistant from said second axis.

34. The apparatus defined by claim 14 wherein said base plate element comprises an opening adapted to receive said elastic bearing and having substantially the same dimensions as said elastic bearing, wherein the diameter of said journal housed in said elastic bearing is substantially equal to the width of said opening in the transverse direction, wherein said opening comprises an end portion toward which said journal housed in said opening is displaced in response to pivoting of said locking cam into said locked position, wherein said elastic bearing comprises an elastic element positioned in said end portion of said opening.

35. The apparatus defined by claim 34 wherein said elastic bearing comprises only said elastic element positioned only in said end portion of said opening.

36. The apparatus defined by claim 14 wherein said locking lever comprises first and second branches, wherein said second branch is positioned on the opposite side of said locking lever from said first branch, wherein said active lateral surface of said locking cam is adapted to contact said second branch.

37. The apparatus defined by claim 36 wherein said active lateral surface of said locking cam contacts said second branch in response to rotation of said locking cam into said locked position.

38. The apparatus defined by claim 14 wherein said locking lever comprises only a single branch, wherein said locking cam is adapted to contact said single branch.

39. The apparatus defined by claim 38 wherein said single branch comprises a first and second end portions, wherein said first end portion is adapted to contact said second longitudinal side of said guide, wherein said first journal is positioned at said second end portion.

40. A subassembly of an apparatus for adjusting the longitudinal position of a safety binding on a ski, wherein said apparatus comprises a guide element and a base plate element receives a binding and slides longitudinally in said guide, wherein one of said elements includes a plurality of notches spaced apart in the longitudinal direction of said apparatus, wherein the other of said elements comprises at least one tooth adapted to engage said notches, wherein said subassembly comprises:

(a) means for locking said at least one tooth in said plurality of notches, wherein said locking means comprises a journal attached to one of said elements; and (b) means for preventing substantial displacement of said journal in a direction transverse to said apparatus by exerting an elastic transverse force on said base plate to substantially eliminate transverse play between said base plate element and said guide element and thus hold said at least one tooth in said plurality of notches.

41. The subassembly defined by claim 40 wherein said displacement prevention means comprises an elastic bearing for housing said journal, wherein said elastic bearing has substantially less transverse elasticity than longitudinal elasticity.

42. The subassembly defined by claim 41 wherein said elastic bearing prevents substantial transverse displacement of said journal.

43. The subassembly defined by claim 42 wherein said elastic bearing has an opening therein for receiving said journal, wherein said elastic bearing comprises a central portion and two end portions extending in the longitudinal direction from opposite sides of said central portion, wherein said central portion is substantially rectangular in shape, wherein said two end portion are substantially semicircular in shape.

44. The subassembly defined by claim 43 wherein said central portion is square in shape.

45. The subassembly defined by claim 43 wherein said opening is positioned in said central portion of said elastic bearing.

46. The subassembly defined by claim 41 wherein said guide element further comprises first and second longitudinal sides, wherein said base plate element comprises first and second longitudinal sides, wherein said at least one tooth extends transversely from said first longitudinal side of one of said elements, wherein said notches are positioned in the first longitudinal side of the other of said elements, wherein said locking means of said subassembly further comprises a first journal and a locking lever having at least one branch having an end, wherein said first journal pivotally mounts said locking lever on said base plate such that said end of said locking lever is adapted to contact said second longitudinal side of said guide, wherein said at least one tooth is maintained in one of said notches in response to pressure of said end of said at least one branch of said locking lever on said second longitudinal side of said guide.

47. The subassembly defined by claim 41 wherein said locking means further comprises a locking cam pivotally attached to said base plate and adapted to rotate between locked, intermediate and unlocked positions, wherein in said intermediate position said cam rotates said locking lever to press said end of said at least one branch of said locking lever on said second longitudinal side of said guide, wherein rotation of said cam from said intermediate to said locked position pivots said locking lever around said end of said at least one branch, thereby longitudinally displacing said first journal against said elastic bearing and biasing said end of said at least one branch against said second longitudinal side of said guide and biasing said at least one tooth into engagement with one of said notches.

48. The subassembly defined by claim 41, wherein said locking means further comprises a locking lever pivotally mounted on said base plate element and a locking cam comprising said journal, wherein said journal is pivotally mounted on said base plate element, wherein said journal is adapted to rotate between locked and unlocked positions, wherein said journal is displaced longitudinally against said elastic bearing in response to rotation of said journal from said unlocked to said locked position, wherein said locking lever comprises means for biasing said base plate element to pivot so that said at least one tooth engages one of said notches in response to rotation of said journal into said locked position.

49. The subassembly defined by claim 40 further comprising an elastic bearing for housing said journal, wherein said locking means further comprises a locking lever pivotally mounted on said base plate element around a first journal and a locking cam comprising a second journal pivotally mounted on said base plate element for rotation between locked and unlocked positions, wherein said locking lever is adapted to rotate around a first axis defined by said first journal, wherein said second journal is adapted to rotate around a second axis, wherein said locking lever comprises means for rotating said base plate element into a locked position in which said at least one tooth engages one of said notches, wherein said cam comprises means for rotating said locking lever to rotate said base plate element into said locked position, wherein said journal housed by said elastic bearing comprises one of said first and second journals, wherein said elastic bearing comprises means for biasing said lever against displacement out of said locked position in response to rotation of said locking cam into said locked position, wherein said transverse displacement prevention means comprises an abutment positioned on said base of said base plate element, wherein said apparatus further comprises a cylindrical surface, wherein said cylindrical surface has an arch-shaped cross-sectional configuration, wherein said cylindrical surface is positioned on said journal housed in said elastic bearing, wherein each point on said cylindrical surface is substantially equidistant from one of said first and second axes, wherein said cylindrical surface contacts said abutment, wherein said abutment comprises a substantially vertical planar surface substantially parallel to the longitudinal axis of symmetry of said apparatus and spaced from said longitudinal axis of symmetry by a distance substantially equal to the distance from said cylindrical surface to one of said first and second axes.

* * * * *

UNITED STATES PATENT AND TRADEMARK OFFICE
CERTIFICATE OF CORRECTION

PATENT NO. : 4,817,981

DATED : April 4, 1989

INVENTOR(S) : JACK DESBIOLLES et al.

It is certified that error appears in the above-identified patent and that said Letters Patent is hereby corrected as shown below:

At column 2, line 3 of the printed patent, change "2,495,279" to ---2,495,479---.

At column 5, line 37 of the printed patent, change "an an" to ---an---.

At column 6, line 38 of the printed patent, change "portion" to ---portions---.

At column 6, line 43 of the printed patent, change "comprise comprise" to ---comprise---.

At column 7, line 38 of the printed patent, change "an an" to ---an---.

At column 7, line 60 of the printed patent, change "crosssectional" to ---cross-sectional---.

At column 9, line 60 of the printed patent, change "gude" to ---guide---.

At column 11, line 8 of the printed patent, delete "comprising".

At column 11, lines 64 and 65 of the printed patent, change "surface comprises" to ---surfaces comprise---.

At column 12, line 1 of the printed patent, change "and an" to ---and a---.

At column 12, line 9 of the printed patent, change "of of" to ---of---.

At column 13, line 19 of the printed patent, change "7 so as to assure the permanant" to ---5b so as to assure the permanent---.

At column 13, line 20 of the printed patent, change "5c" to ---5b---.

At column 14, line of the printed patent, change "maintenance" to ---maintain--.

At column 14, line 19 of the printed patent, change "et 6A. To assure the the" to ---and 6A. To assure the---.

UNITED STATES PATENT AND TRADEMARK OFFICE

CERTIFICATE OF CORRECTION

PATENT NO. : 4,817,981

DATED : April 4, 1989

INVENTOR(S) : JACK DESBIOLLES et al.

It is certified that error appears in the above-identified patent and that said Letters Patent is hereby corrected as shown below:

At column 14, lines 20 and 21 of the printed patent, change "on branch to provide 12c" to ---to provide on branch 12c---.

At column 14, line 22 of the printed patent, insert ---biased--- after "elastically".

At column 14, line 23 of the printed patent, delete "biased" after "branch".

At column 14, line 30 of the printed patent, change "potion" to ---portion---.

At column 14, line 37 of the printed patent, delete "and" after "thereby".

At column 14, line 41 of the printed patent, change "portion" to ---portions---.

At column 14, line 65 of the printed patent, change "planer" to ---planar---.

At column 17, line 17 (claim 13, line 6) of the printed patent, change "the the" to ---the---.

At column 18, line 39 (claim 24, line 1) of the printed patent, change "claim 25" to ---claim 23---.

At column 20, line 41 (claim 43, line 7) of the printed patent, change "portion" to ---portions---.

Signed and Sealed this

Seventeenth Day of November, 1992

*Attest:*

DOUGLAS B. COMER

*Attesting Officer*

*Acting Commissioner of Patents and Trademarks*